United States Patent [19]

Piana et al.

[11] Patent Number: 4,861,280

[45] Date of Patent: Aug. 29, 1989

[54] ELECTRIC CABLE TERMINAL CONSISTING OF TWO INDEPENDENT ELEMENTS TO BE ASSEMBLED BY AXIAL SLIDING

[75] Inventors: Ivana Piana; Silvano Piana, both of Genova, Italy

[73] Assignee: Grafoplast S.p.A., Italy

[21] Appl. No.: 207,285

[22] Filed: Jun. 15, 1988

[30] Foreign Application Priority Data

Jun. 19, 1987 [IT] Italy ..... 12503 A/87

[51] Int. Cl.[4] ..... H01R 13/432; H01R 4/70

[52] U.S. Cl. ..... 439/491; 439/747; 439/879

[58] Field of Search ..... 439/488, 491, 733, 746–750, 439/741, 743, 870–872, 903, 933, 879–882

[56] References Cited

U.S. PATENT DOCUMENTS

| | | | |
|---|---|---|---|
| 3,573,709 | 4/1971 | Elliott | 439/748 |
| 4,214,361 | 7/1980 | Coldren | 29/863 |
| 4,472,017 | 9/1984 | Sian | 439/747 |
| 4,557,048 | 12/1985 | Cordiero | 29/863 |
| 4,580,341 | 4/1986 | Chapelot | 439/747 |
| 4,658,503 | 4/1987 | Eaton | 29/854 |
| 4,764,126 | 8/1988 | Piana | 439/491 |

FOREIGN PATENT DOCUMENTS

| | | |
|---|---|---|
| 035460 | 9/1981 | European Pat. Off. . |
| 117166 | 8/1984 | European Pat. Off. . |
| 1468859 | 1/1967 | France . |
| 2477305 | 9/1981 | France . |

*Primary Examiner*—Gary F. Paumen

*Attorney, Agent, or Firm*—Jacobs & Jacobs

[57] ABSTRACT

This terminal is consisting of two elements, one of which is formed by a metal coupling mechanism (1) a first ring (2) connected to the coupling mechanism (1) and a second ring (6) connected to the first ring (2) by means of a narrow lower link (5), so that the second ring (6) is externally projecting beyond the first ring (2), whereas the other element is formed by a hollow, tubular insulating envelope or sleeve internally featuring various subsequent shapes, i.e. a flaring or bellmouth (8) forming an initial step (9), followed by an annular recess (10), a second step (11) almost centrically located with respect to a cylindrical end section (12), so that the terminal to be used by the operator is obtained by introducing the second ring (6) in the sleeve (7) until it is positioned in the annular recess (10) and resting against the first step (9). After connection to the lead by crimping the first ring (2), the sleeve is moved axially so as to uncover the coupling zone, i.e. until the second ring fits into the end portion of the sleeve against the second step (11).

6 Claims, 3 Drawing Sheets

ELECTRIC CABLE TERMINAL CONSISTING OF TWO INDEPENDENT ELEMENTS TO BE ASSEMBLED BY AXIAL SLIDING

The present invention relates to electric cable terminals consisting of two elements, one of which is a metal part to be secured to the cable lead while the other is acting as an insulating sleeve bearing the cable marking elements. These elements are assembled by axial sliding and the sleeve can rotate with respect to the metal element for a better orientation and easy reading of the marking elements.

BACKGROUND OF THE INVENTION

Terminals which can take on various shapes according to connection requirements are already well known and are including prod, clip-on, ring, spade, and fork type as well as "Faston" (male-female) terminals, etc. These terminals are marked according to various well known marking techniques.

According to currently adopted techniques, one end of the metal components is incorporated by melting into the insulating element of these terminals as described in the French Pat. Nos. 2477305 and 1468859 and in the European Pat. No. 0035460.

These known solutions have two main drawbacks, i.e. the metal element and insulating sleeve are firmly assembled and won't permit rotation of the sleeve after connection, for a better and easier identification of the cables.

The second drawback relates to the fact that the metal component must be secured to the cable lead by using a special crimping tool. Since the insulating part of the envelope is also involved in the crimping procedure, it may be deformed or even become useless, especially if recessed for introduction of sleeve marker rings. To prevent crimping damage, the insulating part is now manufactured in PVC since this material has excellent flexibility and crushing strength. No other plastic materials can be used for this purpose since they cannot withstand crimping stresses.

According to the Italian Pat. No. 12505 A/86, the first drawback was eliminated by rotating the metal component with respect to the insulating sleeve, but the second drawback still remained to be solved.

The European Pat. No. 0117166 is also known, according to which the terminal is obtained from flat die-cut shapes which are progressively bent so as to surround the cable lead. However, this approach has also several disadvantages. In the first place, it prevents the sleeve from being rotated in order to ensure easy reading of the markings. Then, there is the fact that this system requires special tools for deformation of the flat links and for application of the envelope and this equipment must be used on the site where the cables are connected, thus involving discomfort for the operator and loss of time. Furthermore, it seems that this system is only used for prods with the exclusion of all other terminal types.

SUMMARY OF THE INVENTION

The present invention eliminates the above described drawbacks of known terminals and their methods of manufacture. The cable terminal of the present invention may be adapted for any kind of terminals. The sleeve can be turned with respect to the fixed metal component while ensuring that crimping of the metal element on the lead will absolutely not involve the insulating sleeve. Furthermore, manufacture of the terminal of the present invention is simplified, since the metal element and sleeve are separately manufactured and are assembled by axial sliding in two subsequent stages, i.e. first threading the cable and fastening the cable by crimping onto the lead, and then a final stage in which the sleeve will cover the connection between the metal component and the lead.

According to the present invention, a metal component is fitted with a mechanism for connection to the electrical appliances (prod, fork, ring, Faston etc.); this mechanism being coupled by a first ring-shaped zone which then continues, at the end opposite the connecting mechanism, by a second equally ring-shaped but slightly more open zone, so that it will be peripherally projecting. The insulating element has essentially a hollow tubular shape with two internal annular steps which determine, together with the second ring-shaped zone, the two axial sliding positions. The cable markings are visible on the outside of the insulating sleeve and marking may be performed according to well known systems, for instance by means of ring-shaped marking elements introduced in a transparent recess.

All this leads up to a terminal of new structural and functional design by which the markings can be turned for easy identification and the metal element can be crimped onto the lead without restricting rotation of the insulating sleeve which will then cover the connection. The present invention will also make connection of cables to equipment or appliances easier for the operator.

BRIEF DESCRIPTION OF THE DRAWINGS

The cable terminal of the present invention is illustrated for exemplification purposes in the enclosed drawings, in which.

DETAILED DESCRIPTION OF THE DRAWINGS

Figure 1:
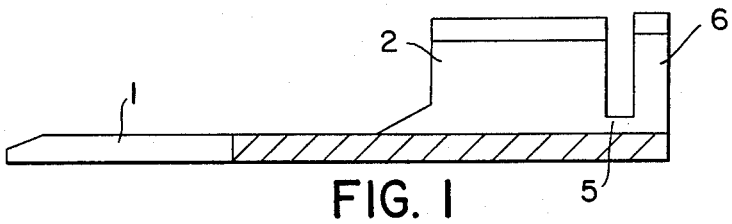
FIGS. 1, 2 and 3 respectively show a vertical section, top view and horizontal section of the metal component of an exemplified fork-shaped connector.
Figure 4:
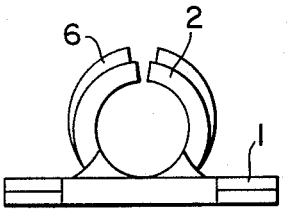
FIGS. 4 and 5 respectively show a view from left and right of the metal component illustrated in FIG. 1.
Figure 2:
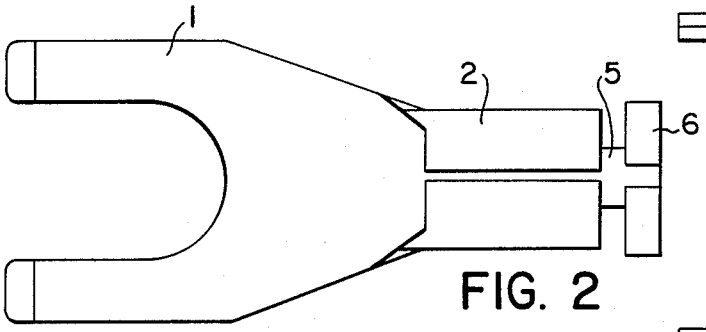
Figure 5:
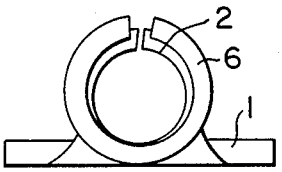
Figure 3:
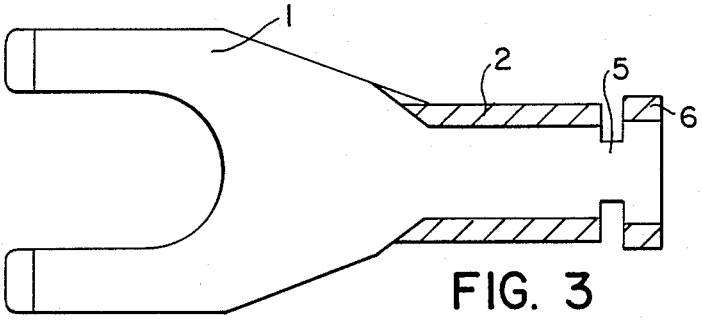

With reference to these Figures, the mechanism 1 is coupled to an electrical equipment or appliance, for instance a fork. This mechanism is first connected to the zone 2 forming a closed ring having a diameter in consistency with the diameter of the lead 3 of cable 4 (illustrated in FIG. 9) and long enough to permit crimping as described hereinafter.

This initial zone 2 is connected by a narrow lower link 5 to a second zone 6 of limited width forming a slightly open ring, so that this second ring 6 is slightly projecting with respect to the first ring 2.

Figure 6:
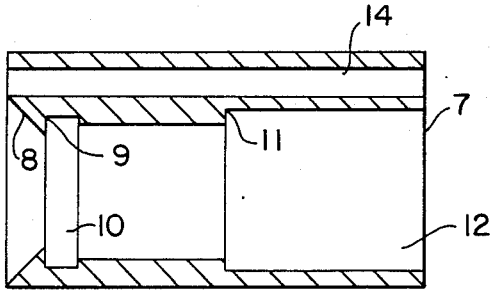
FIG. 6 shows a vertical longitudinal section of the insulating element fitted, for exemplification purpose, with a system of ring-shaped marking elements.
Figure 7:
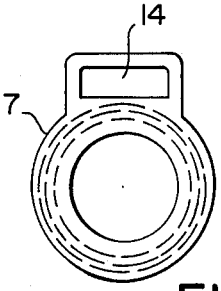
FIG. 7 is an end view of the insulating element of FIG. 6.
Figure 8:
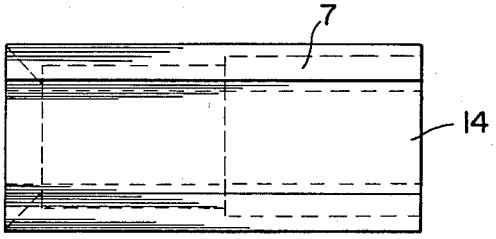
FIG. 8 is a side view of the insulating element of FIG. 6.

The insulating element 7 illustrated in FIG. 6 has a hollow tubular shape and is internally featuring from left to right, i.e. starting from the connecting mechanism, a flaring 8, forming a first step 9, a slight annular recess 10 having the same width as the second ring 6, a second step 11 and an end section 12 having about the same diameter as the annular zone 6. The cable marking will appear on one side of this sleeve, as exemplified in the FIGS. 6, 7 and 8 by means of ring shaped marking elements 13, introduced in a transparent longitudinal recess 14.

Figure 9:
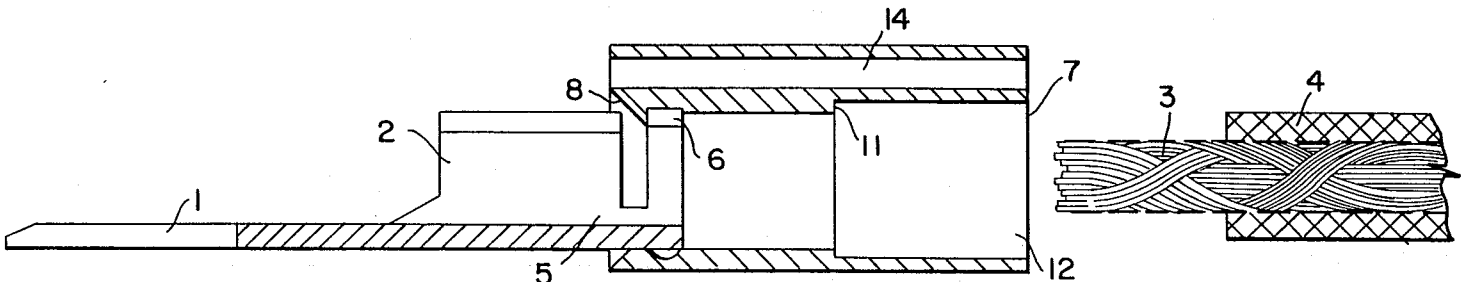
FIGS. 9, 10 and 11 show the progressive assembly stages of the terminal on a cable.

After having thus defined the metal and insulating components, the two parts are assembled as shown in FIG. 9, by fitting the second annular shaped zone 6 into the first section of the sleeve 7, initially causing a deformation of the bellmouth 8 and the first step 9, until this second ring shaped zone snaps into the annular recess 10 where it remains locked through the action of the first step 9.

Figure 10:
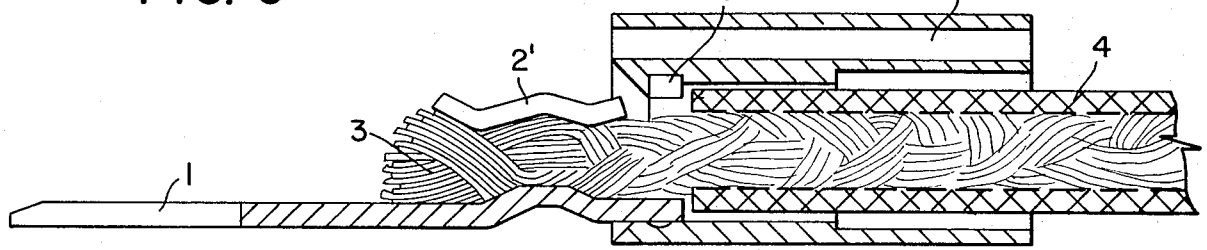

In these conditions, the operator will have access to the terminal and can fit it on the cable featuring the bare lead 3. The operator will then thread this lead into the first ring 2 of the terminal and will use special pinchers for deformation of the ring 2 into 2' thus securing the cable to the terminal as shown in FIG. 10. This operation is easily completed and will not affect the insulating envelope according to the objectives of the present invention.

Figure 11:
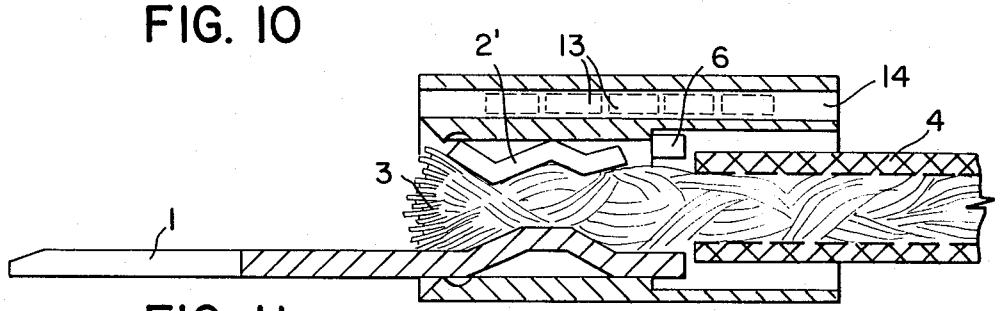

Subsequently, the operator will push the sleeve 7 towards the connecting mechanism 1 until the sleeve 7 covers the terminal/conductor coupling zone, as shown in FIG. 11. By the latter operation, the second annular zone 6 fits into the end section 12 resting against the second step 11 of the sleeve 7.

Figure 12:
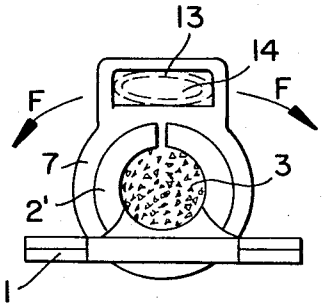
FIG. 12 shows a view from the left of the terminal illustrated in FIG. 11.

The FIGS. 11 and 12 clearly show that the metal component and the insulating element always remain reciprocally independent although there may be a slight friction between the two elements. This means that the sleeve 7 can freely rotate in the direction of the arrows F shown in FIG. 12, so that the identification code can be located in the best position for easy reading, according to the objective of the present invention.

Figure 13:
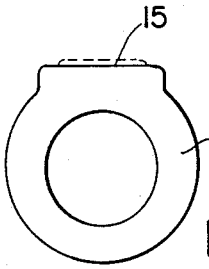
FIGS. 13 and 14 show terminals with other marking systems.
Figure 14:
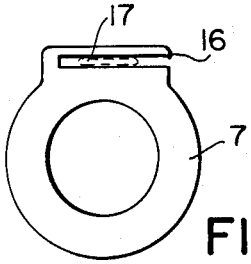

As explained before, the insulating sleeve 7 may provide for cable marking in various modes. Mention has already been made of ring shaped marking elements 13, fitted into a longitudinal recess 14, but the markings 15 may also be directly printed or stamped on the sleeve as shown in FIG. 13, or code labels 17 may be introduced in the slot 16 as shown in FIG. 14. Any marking system may be used for the terminal of the present invention.

The device to be connected to the electric equipment or appliance may also be of any design.

Figure 15:
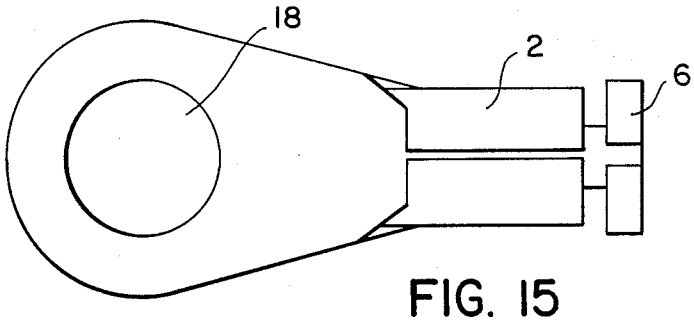
FIGS. 15, 16 and 17 show a top view of the metal component of the terminal with different connecting devices.
Figure 16:
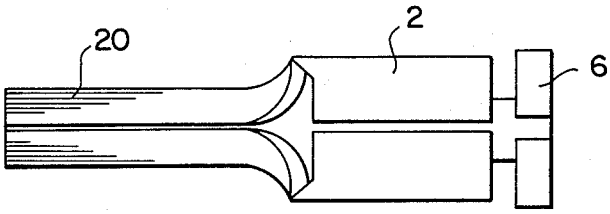
Figure 17:
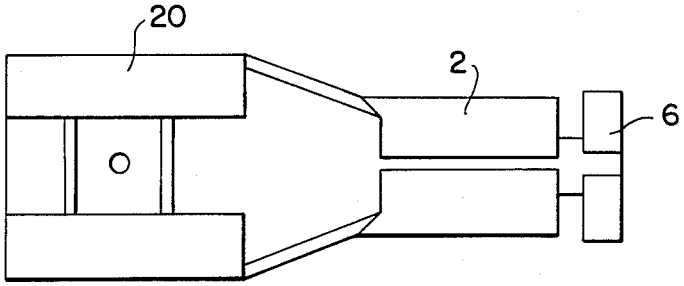

For instance, FIGS. 1 through 12 feature a fork or "spade" type connector 1 for exemplification purposes, but this mechanism may also be ring-shaped 18 as shown in FIG. 15, or a prod 19, as shown in FIG. 16, or a male or female faston 20, as shown in FIG. 17, or a hook, etc.

Obviously, the first and second annular shaped zones 2, 6 may be replaced by complete rings without notches, although the second ring 6 shall always have a slightly larger diameter than the first ring 2.

We claim:

1. A cable terminal comprising an elongated metal conducting element and an elongated tubular insulating sleeve, wherein (a) said elongated metal conducting element comprises (i) a first end terminating in means for connection to an appliance or equipment and an opposed cable receiving end;

(ii) first ring means for securing a cable lead to said conducting element, said first ring means having a length and internal and external diameters and being positioned between said ends of said conducting element; and (iii) second ring means for locking said conducting element in said insulating sleeve, said second ring means being positioned at the cable receiving end of said conducting element, said second ring means being spaced apart from and aligned with said first ring means, said second ring means having an external diameter larger than that of said first ring means;

(b) said elongated tubular insulating sleeve comprises (i) first and second opposed ends and an internal bore extending from said first end to said second end, said bore having a first portion having a diameter substantially the same as the external diameter of said first ring means and a second portion having a diameter substantially the same as the external diameter of said second ring means;

(ii) an internal annular wall defined by the transition from said first portion of said bore to the second portion of said bore;

(iii) an internally directed flaring at said first end of said sleeve; and (iv) an annular recess positioned between said flaring and said first portion of said bore, said annular recess having a length substantially the same as the length of said first ring means and having a diameter smaller than the external diameter of said second ring means;

whereby when said second ring means of said conducting element is inserted into the first end of said sleeve past said flaring of said sleeve, it temporarily mates with said annular recess of said sleeve while a wire lead is secured to said first ring means, said second ring means then being forced through said first portion of said bore past said annular wall into said second portion of said bore whereby said conducting element becomes locked in said insulating sleeve.

2. The cable terminal according to claim 1, wherein the connecting means comprises a fork, a spade, a ring, a prod, or a faston-type connector.

3. The cable terminal according to claim 1, wherein the insulating sleeve is provided with cable identification means.

4. The cable terminal according to claim 3, wherein the cable identification means comprises a slot adapted for displaying a cable marker.

5. The cable terminal according to claim 1, wherein the first and second ring means of the metal element comprise closed rings.

6. The cable terminal according to claim 1, wherein the first and second ring means of the metal element comprise split rings.

* * * * *